United States Patent [19]

Jorgenson

[11] 4,425,849

[45] Jan. 17, 1984

[54] PRIMER ASSEMBLY

[75] Inventor: Gordon K. Jorgenson, Dollard des Ormeaux, Canada

[73] Assignee: C-I-L Inc., North York, Canada

[21] Appl. No.: 379,007

[22] Filed: May 17, 1982

[30] Foreign Application Priority Data

Jun. 22, 1981 [CA] Canada ..... 380677

[51] Int. Cl.[3] ..... F42B 3/10; F42C 19/08

[52] U.S. Cl. ..... 102/275.12; 102/200; 102/202.12; 102/322

[58] Field of Search ..... 102/202.12, 202.14, 102/202.5, 275.9, 275.11, 275.12, 200, 322, 304

[56] References Cited

U.S. PATENT DOCUMENTS

| | | | |
|---|---|---|---|
| 3,793,954 | 2/1974 | Johnston | 102/275.12 |
| 3,931,763 | 1/1976 | Bluhm | 102/202.12 |
| 4,133,247 | 1/1979 | Calder, Jr. et al. | 102/304 |
| 4,178,852 | 12/1979 | Smith et al. | 102/275.9 |
| 4,295,424 | 10/1981 | Smith et al. | 102/322 |
| 4,334,476 | 6/1982 | Day et al. | 102/275.12 |
| 4,383,484 | 5/1983 | Morrey | 102/275.11 |

*Primary Examiner*—Charles T. Jordan
*Attorney, Agent, or Firm*—Donald G. Ballantyne

[57] ABSTRACT

A primer assembly is provided for use in vertical boreholes wherein the primer charge is initiated by means of electric blasting caps, the electric caps, in turn, being initiated electromagnetically. A covered, cup-shaped primer assembly contains a toroid transformer element and connected electric blasting cap in detonating relationship with a primer explosive charge. The assembly is arranged to receive therethrough a looped wire conductor which conductor passes freely through the toroid transformer. When an energy source is coupled to the looped conductor, a magnetic flux is induced in the toroid transformer which sets off the cap and primer charge. The assembly may be passed freely or slid along the looped conductor to any location in the borehole. The assembly permits the use of electric time-delay, deck-charge blasting without the usual hazards associated with normal electric cap blasting.

10 Claims, 4 Drawing Figures

PRIMER ASSEMBLY

This invention relates to the initiation of explosives in large diameter, vertical boreholes such as in open pit and underground mining and quarrying operations. In particular, the invention relates to an explosive primer assembly adapted for initiation by means of delay action electric blasting caps in vertical boreholes charged with explosives.

To achieve the optimum use of explosive energy, to reduce vibrations, and to minimize any detrimental effects to the surrounding environment, it is now well known to employ time-delay blasting techniques. Briefly described, this kind of blasting involves the charging of a borehole or several boreholes with explosives and placing time-delay initiators at intervals along the explosive column. Such initiators may be delay electric blasting caps or non-electric delay caps initiated by means of a detonating cord. Generally the use of electric blasting caps has been avoided for safety reasons and as a matter of convenience since a large number of electric lead wires for each cap employed are required for each borehole. Where the explosive charge is of the low sensitivity type, for example, bulk or packaged ammonium nitrate/fuel oil (ANFO) or aqueous slurry mixtures, it is also necessary to employ a primer or booster charge with each delay blasting cap in order to insure detonation of the relatively insensitive explosive.

Generally, the preferred method of charging a large diameter, vertical borehole for time-delay blasting purposes comprises the steps of charging the borehole with packaged or bulk explosives, and as the borehole is being charged, placing primer charges each containing a delay detonator in contact with the explosive so that the fully charged borehole may contain several primers decked at intervals along its length. The delay cap in each of the primers is selected so as to provide the most efficient blasting results. Upon initiation of the electric or non-electric cap, as the case may be, and associated primers, the borehole charge is initiated in a planned time-delay sequence, usually from bottom to top. Typical non-electric time delay blasting methods are described, for example, in British Pat. No. 858,794 and U.S. Pat. No. 4,133,247. Typical electric time delay blasting methods are described, for example, in U.S. Pat. No. 3,618,519.

In large scale quarrying, underground and open pit mining operations such as in iron ore pit mines, it is the common practise for reasons of economy to load a large number of boreholes with explosives over a period of several days or even weeks and to thereafter initiate nearly simultaneously all the charged boreholes to detonate in time-delay sequence. The employment of such mining methods frequently means that the explosive components in the borehole, including initiating detonating cord lines, and non-electric delay blasting caps and primers, are exposed for long periods of time to conditions of moisture or oil or other chemical contamination from the components of bulk explosives sufficient to cause desensitization of one or other of the delay blasting cap components. Electric time-delay blasting caps and associated components are less subject to such desensitization because of the insulating coating thereon and the tight connections which are possible at the point of entry of lead wires into the electric cap.

In applicant's co-pending United Kingdom application No. 80 24698 filed on July 29, 1980, there is disclosed a method of borehole charging for multiple primer or decked charge blasting utilizing delay electric blasting caps which are initiated electromagnetically. In such a blasting method, an electric blasting cap is employed wherein an insulated continuous lead wire extends from the ignition element and fusehead within the cap assembly which lead wire is wound around a ring-shaped ferrite core element or toroid beyond the cap. The toroid core is electro-magnetically coupled to a primary circuit wire loop which passes slidably through the toroid core element. An energy source is coupled to the primary circuit. In initiating such an electro-magnetic cap, electricity is passed through the primary circuit from the energy source to the wire loop passing through the toroid element, inducing a magnetic flux in the toroid element. This flux, in turn, induces an electric signal in the cap lead wires which actuates the ignition element and fuse head and initiates the cap.

The present invention provides a primer assembly which combines an electromagnetically initiated blasting cap and a priming explosive charge, which assembly may be conveniently employed as a down-the-hole initiator in time-delay, deck blasting techniques. Generally the preferred embodiment of the primer assembly of the invention comprises a closed-bottom, open-top cylindrical container body having a tight-fitting, interlocking, removable cover, the closed bottom of the container body having an aperture therein of a size sufficient to pass therethrough at least a 1.5 mm diameter insulated wire conductor, the container body having therein a cast or formed priming explosive charge, the priming charge having at least one cylindrical tunnel therethrough in alignment with the said bottom aperture, the priming charge also having one or more elongated cylindrical wells therein adapted to receive therein an electric blasting cap, the said priming charge having surmounted thereon a toroid transformer core, a central aperture in the said toroid being in alignment with the said cylindrical tunnel and the said toroid being electrically connected to the said blasting cap, the said interlocking container cover having an aperture therein of a size sufficient to pass therethrough at least a 1.5 mm diameter insulated wire conductor, the cover aperture being in alignment with the said primer tunnel, the cover being adapted to protectively enclose the said toroid and blasting cap.

In a modified embodiment, the primer assembly of the invention comprises a shallow open-top cylindrical cup-shaped body having a tight-fitting, interlocking, removable cover, the said body and cover having aligned apertures therein of a size sufficient to pass therethrough at least a 1.5 mm diameter insulated wire conductor, the said body having means to retain in alignment with the said aperatures a toroid transformer core and the said body having integral therewith a pendant, open tubular element adapted to receive therein an electric blasting cap, the said blasting cap being electrically connected to the said toroid transformer, the cover being adapted to protectively enclose the said toroid and blasting cap, and the said open tubular element being inserted into a yieldable high explosive primer charge.

In the described preferred embodiment the primer charge of cast or formed explosive is contained within a protective shell integral with the assembly while in the modified embodiment the primer explosive may be added to the assembly, as for example, by means of a cartridge of high sensitivity explosive such as dynamite.

The invention will be particularly described by reference to the attached drawing wherein.

Figure 1:
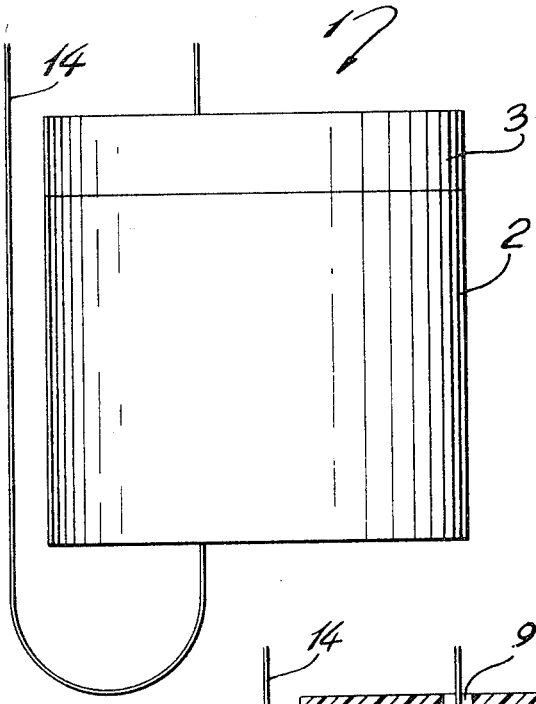
FIG. 1 is a side elevational view of the preferred primer assembly of the invention showing the assembled container body and interlocking lid with an insulated conductor wire passing therethrough.

Referring to the figures of the drawing where like numbers are used to designate like parts, in FIG. 1, 1 represents the primer assembly of the invention consisting of a container body 2 having an interlocking, removable cover 3. A portion of a looped, insulated wire conductor 14 is shown passing through apertures (not shown) in cover 3 and container body 2.

Figure 2:
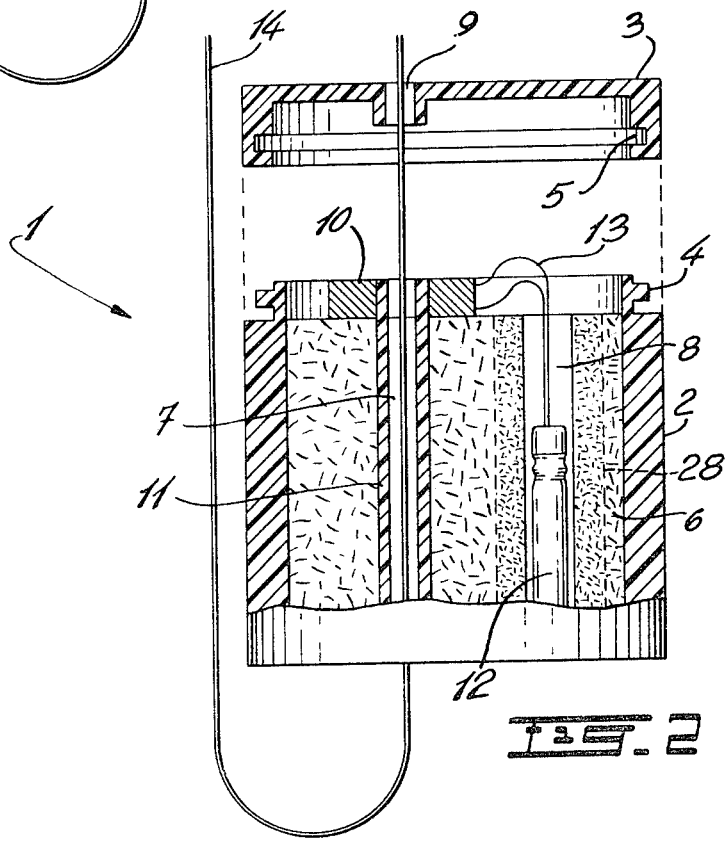
FIG. 2 is an exploded side elevational view, partly in cross-section of the assembly of FIG. 1.

FIG. 2 shows the assembly of FIG. 1 with cup-like container body 2 and cover 3 disconnected and separated. In an alternative arrangement (not shown) container body 2 may comprise an open-ended tube or hollow cylinder having a removable cover like cover 3, at each end. On the upper surface of container body 2 is shown a male thread or lug skirt portion 4 which is adapted to interlock with a corresponding female recess 5 within cover 3. Container body 2 is filled with a cast or formed primer explosive composition 6. Passing entirely through explosive composition 6 is tunnel 7 and indented into composition 6 is cap well 8. Cap well 8 may also, if desired, comprise a tunnel. Cover 3 contains an aperture or opening 9 therein which, by virtue of the location of lugs 4, is positioned in alignment with tunnel 7 in container body 2. Body 2 also contains an opening or aperture (not shown) in its bottom face in alignment with tunnel 7. Located on or near the upper face of primer explosive composition, in a position so that looped wire conductor 14 can pass through it, is a ring-shaped, ferrite core element or toroid 10 whose central aperture is shown in alignment with tunnel 7. Conveniently, a tunnel liner or tube 11 can be provided within tunnel 7 and extending upward therefrom to aid in positioning and retaining toroid 10 in alignment with tunnel 7. An electric blasting cap 12 is shown within cap well or tunnel 8 and connected between cap 12 and toroid 10 is a lead wire 13. Lead wire 13 extends from one terminal of a resistant element (not shown) within cap 12, is wound around (not shown) toroid 10 and terminates in a second terminal of the resistant element within cap 12. A portion of an insulated, looped wire conductor 14 is shown passing through opening 9 in cover 3, through the aperture in toroid 10 and through tunnel 7. Wire 14 is remotely coupled for electromagnetic inductance with an energy source shown as 27 in FIG. 3.

Figure 4:
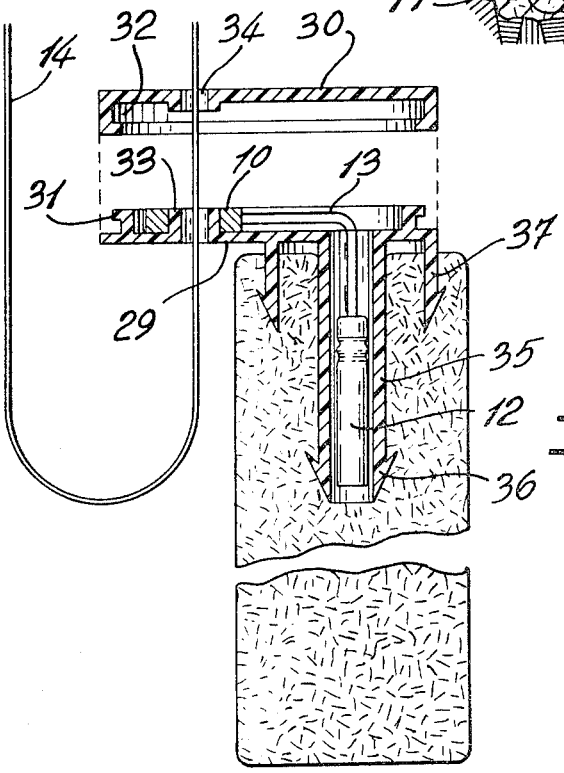

FIG. 4 shows a primer assembly particularly adapted for use with a high sensitivity pliable primer charge, for example, a conventional nitroglycerine dynamite or gelatin cartridge. A body unit 29 and cover 30, made of molded plastic are shown disconnected and separated. Body 29 has a male thread or lug 31 adapted to interlock with a corresponding female recess 32 in cover 30. An integral upward projecting short tube section 33 supports and positions toroid transformer 10. An opening 34, in alignment with tube 33, is shown in cover 30. Extending downward from body 29 is a tubular well element 35 containing electric blasting cap 12. Cap 12 is connected to toroid 10 by lead wire 13. The leading end of tube 35 can be tapered or pointed and provided with projections or barbs 36 thereon to help retain body 29 in place when tube element 35 is pressed into a cartridge of dynamite (as shown) or similar high sensitivity primer material. Projections 37 can also be provided to help position and hold body 29 in relation to a primer. A portion of insulated, looped wire conductor 14 is shown passing through opening 34 in cover 30 and tube 33 and toroid 10 in body 29.

Figure 3:
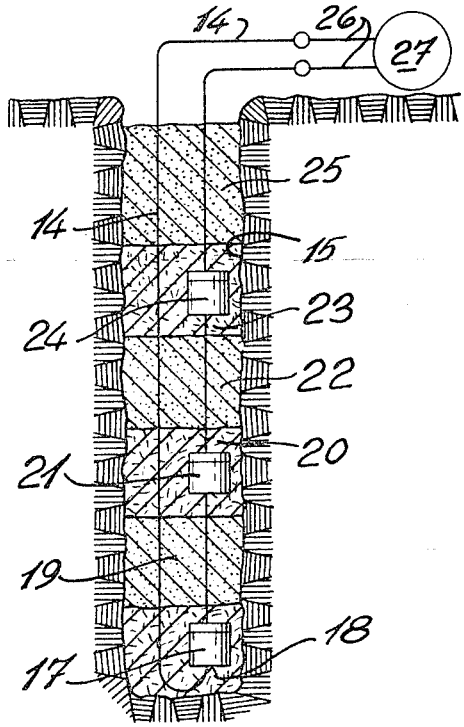
FIG. 3 is a schematic view of a borehole charged with explosives and the primer assembly of the present invention and FIG. 4 is an exploded side elevational view, partly in cross-section, of an alternative embodiment of the primer assembly of the invention adapted for use with a high sensitivity explosive primer.

With particular reference to FIG. 3, illustrated is a typical borehole in rock charged in deck-loaded fashion and employing the primer assembly of FIGS. 1 and 2. Shown is a borehole 15 of, for example, 30 cm diameter and 15 m depth. Extending into borehole 15 is a looped, insulated wire conductor 14. Attached in sliding relationship to the lower end of looped wire 14 is primer assembly 17 having a delay time of, say, 25 milliseconds. A bulk explosive charge 18 such as a slurry blasting agent, is loaded on and above primer assembly 17 and the charge 18 is, in turn, covered with inert stemming material 19. A second charge of explosives 20 is loaded above stemming 19 and simultaneous therewith a second primer assembly 21 of, say 50 milliseconds time delay, is slid down wire 14 to rest within charge 20. Further stemming 22 is placed over charge 20 and a subsequent explosive charge 23 and primer assembly 24 (75 milliseconds time delay) are loaded in a like manner. A final stemming 25 is placed over charge 23. Near the mouth of borehole 15, looped wire conductor 14 is shown electrically coupled to firing cables 26. Firing cables 26 are connected to a source of electrical energy or firing unit 27.

In the above described procedure, a primer assembly as depicted in FIG. 4, used in conjunction with a pliable primer comprising, for example, a dynamite cartridge, may be used in replacement for assemblies 17, 21 and 24.

Container bodies 2 and 29 and covers 3 and 30 are made of a molded plastic such as polyethylene, polypropylene, PVC or the like. A similar material may comprise tunnel liner element 11. Ferrite toroid element 10 may also conveniently be coated or enveloped with a plastic material to protect the wire windings thereon during transportation and assembly.

Priming explosive charge 6 is conveniently premolded from molten explosives such as TNT, PETN or Pentolite (a mixture of TNT and PETN). Tunnel 7 and cap well or tunnel 8 can be formed in any such premold and the solidified casting thereafter simply dropped or positioned within body 2. With such a premolded cast explosive, an inner core surrounding or adjacent to cap well 8 shown by dashed line 28, may be made of a more sensitive explosive such as, for example, Pentolite, while the remainder of the casting can comprise a less sensitive and less costly explosive such as TNT. Alternatively, explosive primer 6 may be cast directly into container body 2 employing molten explosives with removal pins (not shown) being used to create tunnel 7 and cap well or tunnel 8. Primer explosive 6 may also be made from any number of known flexible explosive compositions such as that comprising an amount of particulate cap-sensitive explosive, such as PETN, in a resin matrix consisting of, for example, tetrafluoroethylene resin.

The insulated looped wire 14 is preferably a length of about 0.61 mm diameter copper insulated with polyvinyl chloride to an outside diameter of about 1.15 mm. Toroid core 10 conveniently has an outside diameter of about 2.5 cm and a cross-sectional area of about 15 $mm^2$ and comprises a ferrite material of high permeability. Lead wire 13 is constituted of about 0.6 mm diameter copper wire coated to an outside diameter of about 1.15 mm with PVC. Lead wire 13 is looped or wound five times around toroid core 10. Firing unit 27 includes a signal generator having an output frequency of 10 kHz driving a 25-watt power amplifier designed to work into a 16 ohm load. The amplifier output is coupled directly to a twin core firing cable 26 in which each core consists of 7 strands of 0.4 mm diameter copper wire and is insulated to a total diameter of 3.1 mm using polyvinyl chloride, the total resistance of the firing cable being 4 ohms.

In the arrangement represented in FIG. 3 the following method of firing actuates blasting cap 12 within each of the primer charges 17, 21 and 24. Energy source or firing unit 27 generates an electrical firing energy which is delivered to insulated looped wire 14 passing through toroid 10 within the primer assembly. By virtue of the electromagnetic coupling between looped wire 14 and toroid 10, a magnetic flux is induced in toroid 10. The electromagnetic coupling between toroid 10 and lead wire 13 induces an electrical signal which in turn actuates blasting cap 12.

The primer assembly of the invention permits the convenient and safe electrical initiation of explosive charges in time-delay, deck-charged blasting. The assembly may conveniently be slid into a borehole along an energy-inducing wire conductor without the need to make any mechanical connections. In addition, the protective plastic housing of the assembly provides protection against shock and damage within the environment of the borehole and, because of the induced current ignition system, is immune from premature firing from stray currents. The primer assembly, devoid of any toroid/blasting cap elements, is preferably delivered to the blasting site where the blaster may then simply insert the toroid/cap elements of the desired delay interval for the blast to be undertaken. In such a way the primers are not armed until just before insertion into the borehole.

I claim:

1. A primer assembly for initiating explosives in a vertical borehole by means of electric blasting caps which are initiated electromagnetically comprising:

(a) a priming charge of high explosives, (b) a cylindrical, open-top, cup-like container body having means thereon to support a toroid transformer element and attached lead wires and electric blasting cap, said blasting cap being positioned in detonating relationship with the said priming charge of high explosives, and (c) an interlocking cover for said cylindrical cup-like container, the said cylindrical cup-like container and interlocking cover having apertures therein at a location in alignment with the hollow center of the said toroid transformer element, said apertures being at least of a size to permit free slidable passage therethrough of an insulated electric wire having a diameter of at least 1.15 mm.

2. An assembly as claimed in claim 1 wherein the said priming charge of high explosives is selected from the group of moldable crystalline high explosives, flexible explosives and nitroglycerine/nitroglycol based high explosives.

3. An assembly as claimed in claim 1 wherein the said cup-like container and interlocking cover comprise a moldable plastic material.

4. An assembly as claimed in claim 1 wherein the means to support the said toroid transformer element comprises a hollow, upstanding tubular section.

5. A primer assembly for initiating explosives in a vertical borehole by means of an electromagnetically initiated blasting cap, comprising a closed-bottom, open-top cylindrical container body having a tight-fitting, interlocking, removable cover, the closed bottom of the container body having an aperture therein of a size sufficient to pass therethrough at least a 1.5 mm diameter insulated wire conductor, the container body having therein a cast or formed priming explosive charge, the said priming charge having at least one cylindrical tunnel therethrough in alignment with the said bottom aperture, the said priming charge also having one or more elongated cylindrical wells therein adapted to receive an electric blasting cap, the said priming charge having surmounted thereon a toroid transformer core, a central aperture in the said toroid being in alignment with the said cylindrical tunnel and the said toroid being electrically connected to the said blasting cap, the said interlocking container cover having an aperture therein of a size sufficient to pass therethrough at least a 1.5 mm diameter insulated wire conductor, the cover aperture being in alignment with the said primer tunnel, the said cover being adapted to protectively enclose the said toroid, blasting cap and priming charge.

6. A primer assembly as claimed in claim 5 wherein the priming explosive charge is cast in place in the said container body.

7. A primer assembly as claimed in claim 5 wherein the priming explosive charge is pre-molded and thereafter placed in the said container body.

8. A primer assembly for initiating explosives in a vertical borehole by means of an electromagnetically initiated blasting cap, comprising a shallow, open-top cylindrical cup-shaped body having a tight-fitting, interlocking, removable cover, the said body and cover having aligned apertures therein of a size sufficient to pass therethrough at least a 1.5 mm diameter insulated wire conductor, the said body having means to retain in alignment with the said apertures a toroid transformer core and the said body having integral therewith a pendant, open tubular element adapted to receive therein an electric blasting cap, the said blasting cap being electrically connected to the said toroid transformer, the cover being adapted to protectively enclose the said toroid and blasting cap and the said open tubular element being inserted into a pliable, high explosive primer charge.

9. A primer assembly as claimed in claim 8 wherein the said pliable high explosive primer is a cartridge of nitroglycerine/nitroglycol based explosive.

10. A primer assembly as claimed in claim 8 wherein the said cup-shaped body has one or more spike-like projections thereon to maintain the said body in contact with the said pliable primer charge.

* * * * *